United States Patent [19]

Di Sturco

[11] Patent Number: 4,858,760

[45] Date of Patent: Aug. 22, 1989

[54] COMPOUND CAP FOR USE WITH A BOTTLE

[76] Inventor: Paolo Di Sturco, Viale Nuova Florida 41, Ardea- Roma, Italy

[21] Appl. No.: 213,903

[22] Filed: Jun. 30, 1988

[30] Foreign Application Priority Data

Jul. 2, 1987 [IT] Italy ..... 35888/87[U]

[51] Int. Cl.[4] ..... B65D 25/08

[52] U.S. Cl. ..... 206/222; 215/DIG. 8

[58] Field of Search ..... 206/222; 215/250, DIG. 8

[56] References Cited

U.S. PATENT DOCUMENTS 3,840,136 10/1974 Lanfranconi ..... 206/222 X 3,968,872 7/1976 Cavazza ..... 206/222

FOREIGN PATENT DOCUMENTS 2459683 10/1975 Fed. Rep. of Germany ..... 206/222

*Primary Examiner*—Donald F. Norton

*Attorney, Agent, or Firm*—Notaro & Michalos

[57] ABSTRACT

The invention relates to a cap containing a powder to be diluted in a solvent medium at the moment of utilization, and so shaped as to hermetically close a bottle containing said solvent, said cap being provided with means suitable to remove a separating septum in order to allow the powder hold in the cap to fall into the solvent and the mix therewith.

4 Claims, 1 Drawing Sheet

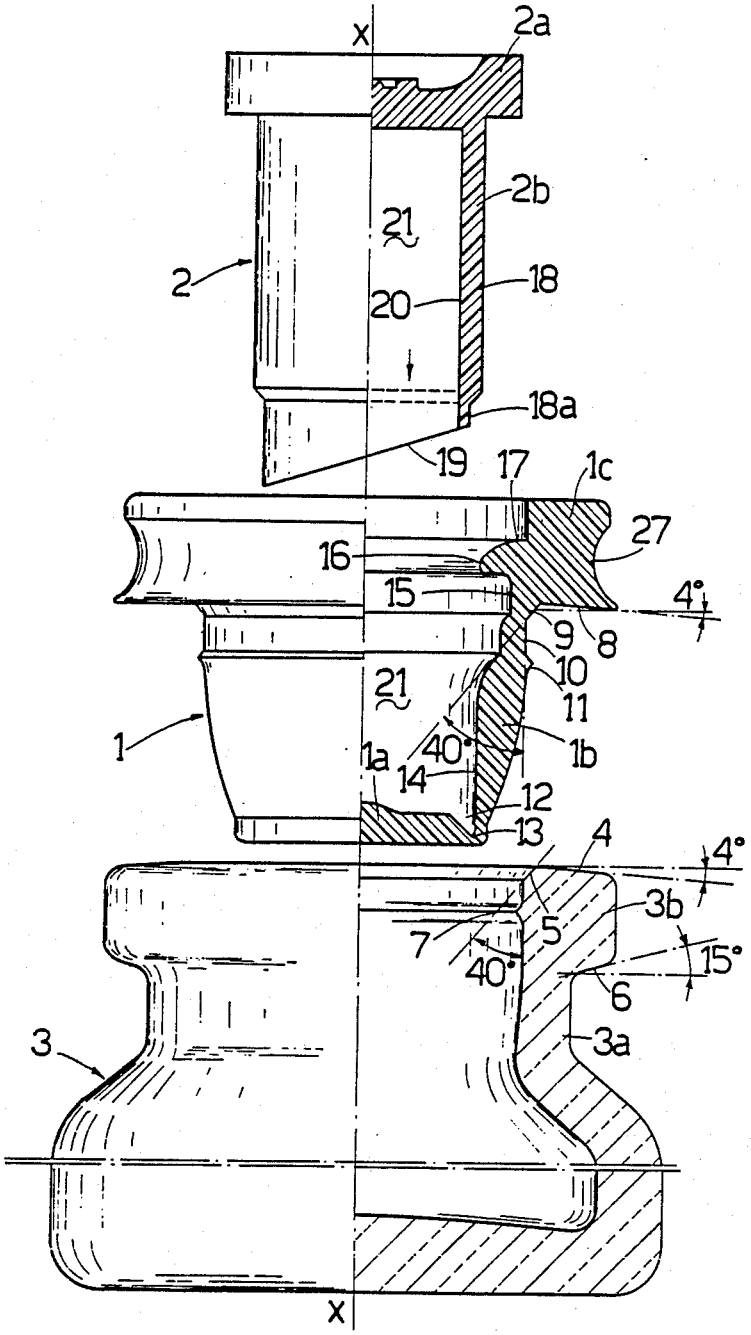
X
2a
2b
21
2
18
20
18a
19
17
1c
27
16
15
4°
9
8
10
21
11
1
40°
1b
1a
14
12
13
4
4°
3b
5
7
40°
15°
6
3
3a
X

COMPOUND CAP FOR USE WITH A BOTTLE

The invention relates to a compound cap formed by two co-axial elements, made of elastically deformable plastics and meant to contain a powder product to be mixed with a liquid solvent that is held in a container closed by said cap.

Another characteristic of the invention is the special shape of the cap, whereby the latter is perfectly tight, and prevents the liquid from leaking out, when the container is being handled.

There are known, and mainly used in the pharmaceutical field, caps consisting of a pair of elements partly inserted in each other, and such as to define a chamber suitable to hold a powder product to be diluted in a solvent contained in a bottle.

By exerting a pressure on the cap, one wall of the same is broken, so that the powder product falls in the solvent and a ready-to-use solution is obtained.

The purpose of the present invention is that of obtaining a cap of the above described kind, but having better tightness, so as to avoid any risk of the solvent leaking out of the bottle during handling.

This is achieved thanks to the special shape of the cap according to the invention, in the way specified by the characterizing part of the claims.

Actually, the cap according to the invention consists of a pair of co-axial elements, defined by revolution surfaces, the outer surface of the cap being so shaped as to define three separate and spaced apart annular areas, fit to act as a barrier against any possible leaking, and to make the cap perfectly fit the mouth of the bottle that contains the solvent.

The invention cap is preferably made of plastic material of the resiliently deformable kind, whilst the bottle is made of hard material, preferably glass.

The invention will be now described in detail, by mere way of non-limiting example, with reference to the only enclosed FIGURE that shows the partially sectioned, exploded view of a cap according to the invention and the relevant bottle.

With reference to the drawing, by No. 1 and No. 2 are generally indicated the two pieces of which the cap consists, whilst by No. 3 is indicated the bottle intended to hold the solvent.

The bottle has a cylindrical neck 3*a*, enlarged on the upper part, so as to form a head consisting of an outward protruding, annular flange or edge 3*b* for making the grasp of the bottle itself easier.

The upper wall 4 of flange 3*b* has the shape of a truncated cone, the vertex laying on the axis XX, shared by both the cap and the bottle.

At the mouth of bottle 3 there is a reverse, truncated cone-like countersink 5, below which there is an annular protrusion 7, with triangular section.

The lower surface 6 of the annular edge 3*b* too has the shape of a truncated cone.

These characteristics of the bottle are well known.

The invention aim is, as above stated, that of obtaining a cap capable of perfectly fitting to this type of bottles, so as to be entirely water-proof.

To this end, what counts most is the shape of the outer surface of the element 1 that forms the cap, element that comprises a lower wall or diaphragm 1*a* and a side wall 1*b*, that widens out at the top, defining an annular flange or head 1*c* that is provided, outwardly, with a groove 27 for making the grasp of the cap itself more comfortable.

The lower surface 8 of the annular flange 1*c* has a truncated cone-like shape, complementary to the surface 4 of the annular flange 3*b* of the bottle, but expanding radially to a greater extent, so that said wall 8 stretches out outwardly to some extent, in order to improve tightness.

The truncated cone-like surface 8 is connected to another truncated cone-like surface 9 complementary to the surface 5 of the bottle.

Surface 9 is linked in turn to a cylindrical part 10, beneath which there is an annular protrusion 11, with wedge-like cross section. The distance of protrusion 11 from surface 8 is such that, when element 1 is inserted in the neck of bottle 3, said annular protrusion 11, while undergoing a resilient deformation, extends beyond the rib 7 that is present inside the neck 3*a* of the bottle, and blocks up beneath it because of the elastic expansion, preventing the cap from coming out. Thanks to this arrangement of the various parts, with surfaces 8 and 9 perfectly fitting the surfaces 4 and 5 of bottle 3, a watertight seal is achieved against any possible leakage of the solvent from the bottle.

The lower part of element 1 is closed by a lower wall 1*a* provided, on its peripheral surface, with a triangular groove 12 defining an area of lesser thickness 13 where the wall, accordingly, offers a lower mechanical resistance and forms a breaking line.

The inner part 14 of the lower segment 1*b* of element 1 has a cylindrical shape and enlarges at the top at 15, and then gets narrower again defining an annular protrusion 16, the radius of which is equal to that of part 14. The protrusion 16 acts as a guide for the insertion of the second element (2) of the cap. Element 2 consists substantially of a cylindrical body 2*b* having a slightly enlarged upper head 2*a*, so as to make the grasp of the cap itself easier.

The outer surface 18 of the cylindrical body 2*b* has a diameter that is slightly greater than the inner diameter of both the annular protrusion 16 and the part 14 of element 1.

The lower end part 18*a* of element 2 has a lesser section and is cut at 19 in the shape of a mouthpiece of a flute, so as to form a sharper and more cutting edge that is for piercing the bottom 1*a* in correspondence of the breaking line 13.

The hollow, substantially cylindrical inner part of element 2 defines, together with element 1, a chamber 21 intended for holding the powder product to be afterwards introduced in the bottle 3.

When preparing the product, the proper dose of solvent is first put in bottle 3, whilst element 1 is filled with the powder product, that deposits on the bottom, inside the cylindrical wall 14.

Element 2 is then inserted inside element 1, slightly forcing it downwards after resiliently deforming the annular protrusion 16, until the end part of element 2 exerts a resilient pressure against wall 14, so as to hermetically seal chamber 21.

During this stage element 2, as above said, is pressed downwards by a slight pressure, sufficient to establish a proper contact between elements 1 and 2 of the cap, that is subsequently inserted into the neck of bottle 3. This step is carried out by holding flange 1*c* until the two truncated cone-like surfaces 8, 9 of element 1 match with and abut against the corresponding annular, truncated cone-like surfaces 4, 5 of head 3*b* of neck 3*a* of bottle 3.

During this step, the outer annular protrusion 11 of element 1 is resiliently deformed for the purpose of passing beyond the inner protrusion 7 of bottle 3.

Then the annular protrusion 11, not being subjected to pressure any longer, resiliently recovers its original shape setting thus firmly the cap upon the bottle: in fact, it brings about an axial pressure that keeps resiliently in contact the facing surfaces 8,4 and 9,5. Any possible leakage during the making, storing, transport and handling of the product is thus prevented. At the moment of utilization, one has only to force element 2 further downwards to make the lower wall 1*a* of chamber 21 break, and allow the powder material to fall down and mix with the solvent.

I claim:

1. A compound cap for use with a bottle (3) having a neck (3*a*) with an inner surface, and annular protrusion (7) on the inner surface, and a mouth having a countersink (5) above the annular protrusion, the bottle having a widened head (3*b*) with an upper truncated cone-like surface (4) around the mouth, the compound cap comprising: first and second coaxial elements (1,2) each made of elastically deformable plastic material and each comprising one body defined by revolution surfaces around a common axis (x-x); the first element (1) being hollow and having a lower wall (1*a*) provided with a periphery having an annular area of lesser resistance defining a breaking line (13), the first element including a side wall (1*b*) with an upper annular head (1*c*), the side wall having an outer surface which is shaped for fitting into the neck of the bottle; the second element (2) comprising a cylindrical body (2*b*) having an outer diameter which is substantially equal to a minimum inner diameter of the hollow first element (1), the second element including a head (2*a*) at the top of and extending outwardly from the cylindrical body, the cylindrical body having a lower flute shaped mouthpiece (19); the side wall (1*b*) of the first element having an outer surface in the area of the head (1*c*) of the first element which carries a truncated cone-like surface (9) which is shaped to match the countersink (5) of the bottle, the head (1*c*) of the first element having a lower surface (8) extending outwardly around the side wall (1*b*) and having a truncated cone-like shape which matches the shape of the truncated cone-like surface (4) of the bottle, the outer surface of the side wall (1*b*) including a cylindrical part (10) extending downwardly of the truncated cone-like surface (9) of the outer surface, the outer surface of the side wall including an annular protrusion (11) which is spaced from the lower surface (8) of the head (1*c*) of the first element, by a distance so that when the lower surface (8) of the head (1*c*) of the first element is in contact with the truncated cone-like surface (4) of the bottle, the annular protrusion (11) of the first element is positioned immediately below the annular protrusion (7) of the bottle.

2. A compound cap according to claim 1 wherein the annular protrusion (11) of the first element has a wedge-like cross-section.

3. A compound cap according to claim 1 wherein the side wall and head of the first element (1) have an inner surface which is formed in succession starting from the lower wall (1*a*) of the first element, as a cylindrical part (14) whose diameter is slightly less than the outer diameter of the cylindrical body (2*b*) of the second element, a hollow part (15) and an inner annular protrusion (16) having a minimum radius substantially corresponding to a minimum inner radius of said cylindrical part (14) of the inner surface of said side wall and head of said first element.

4. A compound cap according to claim 1 wherein the head (1*c*) of the first element has a size which is selected so that it extends outwardly to a greater extent than the head (3*b*) of the bottle, when the first element (1) is seated in the neck of the bottle.

* * * * *

UNITED STATES PATENT AND TRADEMARK OFFICE

CERTIFICATE OF CORRECTION

PATENT NO. : 4,858,760

DATED : August 22, 1989

INVENTOR(S) : Paolo Di Sturco

It is certified that error appears in the above-identified patent and that said Letters Patent is hereby corrected as shown below:

On the title page Insert

-- (73) Assignee: Sigma-Tau Industrie Farmaceutiche Riunite S.p.A. Rome, Italy" --.

Signed and Sealed this

Eleventh Day of September, 1990

*Attest:*

HARRY F. MANBECK, JR.

*Attesting Officer*

*Commissioner of Patents and Trademarks*